US009702329B2

(12) United States Patent
Rosu

(10) Patent No.: US 9,702,329 B2
(45) Date of Patent: Jul. 11, 2017

(54) PUMP AND COMMON RAIL FUEL INJECTION SYSTEM

(71) Applicant: Continental Automotive GmbH, Hannover (DE)

(72) Inventor: Cristian Adrian Rosu, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 482 days.

(21) Appl. No.: 13/765,935

(22) Filed: Feb. 13, 2013

(65) Prior Publication Data

US 2013/0206110 A1 Aug. 15, 2013

(30) Foreign Application Priority Data

Feb. 14, 2012 (EP) ..... 12155268

(51) Int. Cl.
*F02M 69/50* (2006.01)
*F02M 59/10* (2006.01)
(Continued)

(52) U.S. Cl.
CPC ..... *F02M 69/50* (2013.01); *F02M 59/102* (2013.01); *F02M 59/44* (2013.01); *F04B 1/0426* (2013.01)

(58) Field of Classification Search
CPC ..... F04B 1/053; F04B 1/0426; F04B 1/0404; F02B 2275/18; F01L 1/053; F16K 31/1221; F01B 29/04
(Continued)

(56) References Cited

U.S. PATENT DOCUMENTS 3,822,683 A * 7/1974 Clouse ..... F02M 59/102 123/90.5
5,809,956 A * 9/1998 Regueiro ..... F01L 1/143 123/90.27
(Continued)

FOREIGN PATENT DOCUMENTS

DE 19501060 A1 7/1996 ..... B21K 1/00
DE 102008015548 A1 * 10/2009 ..... F02M 59/102
(Continued)

OTHER PUBLICATIONS

European Search Report, Application No. 12155268.1, 5 pages, Jul. 5, 2012.

*Primary Examiner* — Erick Solis
*Assistant Examiner* — Anthony L Bacon
(74) *Attorney, Agent, or Firm* — Slayden Grubert Beard PLLC

(57) ABSTRACT

A high-pressure pump may include a cylinder, a plunger reciprocally driven by an eccentric to pressurize a pump chamber in the cylinder, a rider mounted on the eccentric to allow relative rotation of the eccentric, the rider presenting a face to the plunger, a tappet supported on the face of the rider for transmitting reciprocal movement from the rider to the plunger, and rotatable bearing elements that support the tappet for relative transverse movement of the face of the rider during operation of the pump. The rotatable bearing elements may be at least partially recessed in a body of the tappet. A common rail fuel injection system for an internal combustion engine comprising a common rail for distributing fuel to a plurality of fuel injectors associated with combustion cylinders of the engine may include such a pump for delivering fuel at high pressure to the common rail.

17 Claims, 1 Drawing Sheet

(51) Int. Cl.
*F04B 1/04* (2006.01)
*F02M 59/44* (2006.01)

(58) Field of Classification Search
USPC ..... 92/59, 129; 123/90.27, 456; 417/273, 417/470, 471
See application file for complete search history.

(56) References Cited

U.S. PATENT DOCUMENTS

| | | | | |
|---|---|---|---|---|
| 5,823,091 | A * | 10/1998 | Collingborn | F04B 1/053 417/238 |
| 6,077,056 | A * | 6/2000 | Gmelin | F02M 59/06 417/273 |
| 6,099,259 | A * | 8/2000 | Monk | F04B 39/0094 417/15 |
| 6,991,438 | B2 * | 1/2006 | Blessing | F04B 1/0426 417/273 |
| 7,513,190 | B2 * | 4/2009 | Boehland | F02M 59/102 417/273 |
| 8,522,755 | B2 * | 9/2013 | Boecking | F04B 1/0408 123/495 |
| 2007/0116583 | A1 * | 5/2007 | Aoki | F02M 47/027 417/437 |
| 2009/0071446 | A1 * | 3/2009 | Sato | F02M 59/102 123/495 |
| 2010/0037865 | A1 * | 2/2010 | Fuchs | F04B 1/0439 123/508 |
| 2013/0206110 | A1 * | 8/2013 | Rosu | F02M 69/50 123/456 |

FOREIGN PATENT DOCUMENTS

| | | | | |
|---|---|---|---|---|
| EP | 1707794 | A1 | 10/2006 | F01L 1/14 |
| EP | 2182210 | A2 | 5/2010 | F02M 59/10 |
| GB | 400250 | A * | 10/1933 | F02M 59/34 |
| JP | 59063361 | A * | 4/1984 | F02M 59/102 |
| JP | 2008088893 | A * | 4/2008 | F02M 59/102 |
| WO | 2005/111405 | A1 | 11/2005 | F02M 59/06 |
| WO | 2010/139663 | A1 | 12/2010 | F04B 1/04 |

* cited by examiner

PUMP AND COMMON RAIL FUEL INJECTION SYSTEM

CROSS-REFERENCE TO RELATED APPLICATIONS

This application claims priority to EP Patent Application No. 12155268 filed Feb. 14, 2012. The contents of which is incorporated herein by reference in its entirety.

TECHNICAL FIELD

The present disclosure relates to a pump, and particularly to a pump for delivering liquid at high pressure. The pump may be embodied as a radial piston pump and is particularly suitable for application as a fuel supply pump for supplying fuel under high pressure to an accumulator or directly to a common rail of a common rail fuel injection system for an internal combustion engine.

BACKGROUND

Known pump mechanisms for common rail fuel injection systems have a number of disadvantages. The sliding-type common rail pump mechanism comprises a tappet which slides on a rider. As a result, this mechanism generates a large amount of heat which leads to a decrease in the life of the reciprocating components. Furthermore, to generate higher pressures with this mechanism, larger components are required, which in turn makes it difficult to fit the pump into smaller engines. Another type of common rail pump comprises a roller and shoe running on a single or multi-lobe cam. While this design has the advantage of producing less heat, the pressure capability is limited given the space available in the engine. Also, the rolling inertia tends to impact negatively upon the fatigue strength of the cam and roller when the parts are made larger due to pressure requirements.

SUMMARY

One embodiment provides a pump for delivering liquid at high pressure, especially for delivering fuel at high pressure to a common rail of a common rail fuel injection system for an internal combustion engine, the pump comprising: a cylinder, a plunger which is reciprocally driven by an eccentric to pressurize a pump chamber in the cylinder, a rider mounted on the eccentric to allow relative rotation of the eccentric, the rider presenting a face to the plunger, a tappet which is supported on the face of the rider for transmitting reciprocal movement from the rider to the plunger, and a plurality of rotatable bearing elements which support the tappet for trans-verse movement of the face of the rider during operation of the pump, wherein the rotatable bearing elements are accommodated at least partially recessed in a body of the tappet.

In a further embodiment, the tappet has a block-like body and accommodates the plurality of rotatable bearing elements in respective cavities such that each bearing element is recessed into the tappet body.

In a further embodiment, each rotatable bearing element is elongate and generally cylindrical, especially in the form of a needle roller, and wherein the plurality of rotatable bearing elements are arranged to extend substantially parallel to one another.

In a further embodiment, the cavities in the body of the tappet are substantially parallel channels for receiving and retaining the rotatable bearing elements, wherein each of the channels has a cross-section substantially conforming to an outer profile of the respective bearing element.

In a further embodiment, the cross-section of each cavity formed in the tappet body encompasses at least 50 percent of the outer profile of the respective bearing element.

In a further embodiment, the pump further comprises a retaining device for retaining the at least one rotatable bearing element in the tappet body during transverse movement of the face of the rider relative to the tappet, the retaining device comprising at least one elongate member which extends across an axial end of the rotatable bearing element recessed in the tappet body.

In a further embodiment, the body of the tappet is substantially rectangular and the face of the rider upon which the tappet is supported is substantially flat or planar.

In a further embodiment, the rotatable bearing element provides at least a partial hydrodynamic bearing for the tappet.

In a further embodiment, the pump further comprises guide means for constraining the tappet against rotation about a central or longitudinal axis of the plunger.

In a further embodiment, the plunger is partially housed in the cylinder and is reciprocally movable to pressurize the pump chamber in the cylinder.

In a further embodiment, the pump comprises a plurality of cylinders, each of which has a respective plunger reciprocally driven by the eccentric to pressurize the pump chamber in the cylinder, wherein the rider rotatably mounted on the eccentric presents a separate face to each respective plunger, and a separate tappet is associated with each respective plunger for transmitting reciprocal movement from the rider to the respective plunger.

Another embodiment provides a common rail fuel injection system for an internal combustion engine comprising: a common rail for distributing fuel to a plurality of fuel injectors associated with combustion cylinders of the engine and a pump according to any one of claims 1 to 11 for delivering fuel at high pressure to the common rail.

BRIEF DESCRIPTION OF THE DRAWINGS

Exemplary embodiments will be explained in more detail below on the basis of the schematic drawings, wherein.

DETAILED DESCRIPTION

Figure 1:
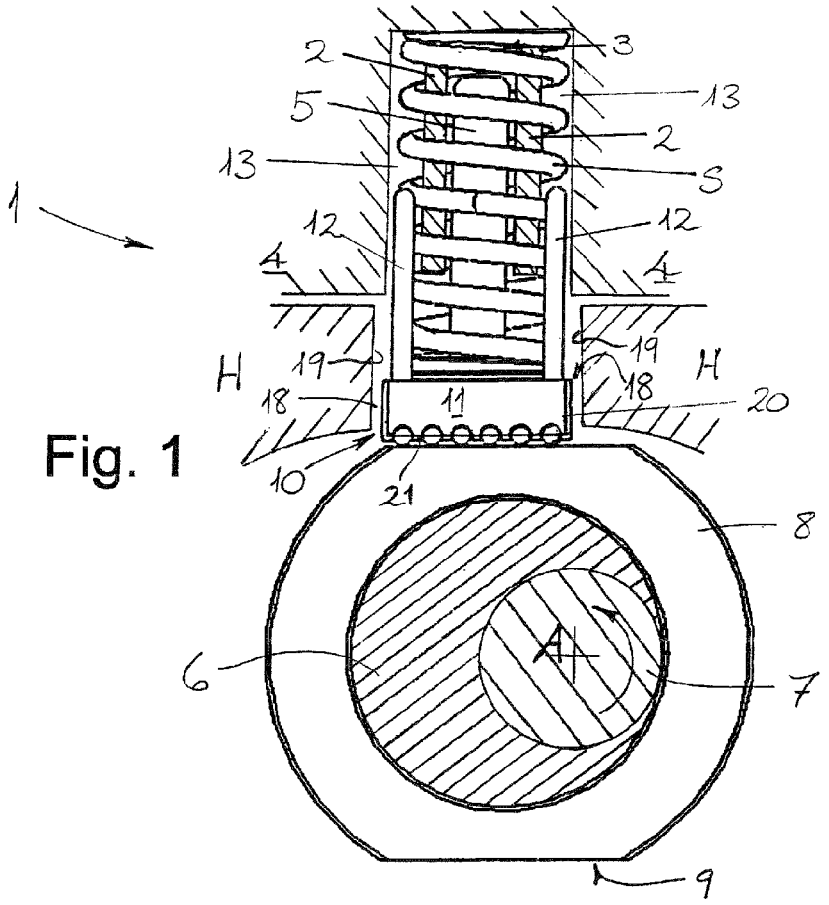
FIG. 1 depicts a schematic cross-sectional view of part of a pump according to an example embodiment of the present disclosure.

Embodiment of the present disclosure provide a new pump design suitable for delivering fuel at high pressure to a common rail of a common rail fuel injection system which addresses one or more of the disadvantages discussed above.

Some embodiment provide a pump for delivering liquid at high pressure, and especially for delivering fuel at high pressure to a common rail of a common rail fuel injection system for an internal combustion engine, the pump comprising: a cylinder, a plunger which is reciprocally driven by an eccentric on a drive shaft to pressurize a pump chamber in the cylinder, a rider mounted on the eccentric to allow relative rotation of the eccentric and presenting a face to the plunger, a tappet supported on the face of the rider for transmitting reciprocating movement from the rider to the plunger, and one or more, in particular two or more, rotatable bearing elements which support the tappet for transverse movement over the face of the rider during operation of the pump, wherein the rotatable bearing elements are accommodated at least partially recessed in a body of the tappet. With this configuration, the pump is able to realize pumping pressures hitherto unavailable in common rail fuel injection systems with pumps of the same or comparable size, while avoiding excessive heat generation.

The pump may thus include a tappet which is supported by the one or more rotatable bearing element for relative rolling movement over the face of the rider. In this regard, it is typically the rider, and thus the face of the rider, which moves transversely or laterally relative to the tappet. The rider is mounted relatively rotatable on the eccentric, which, in turn, is rotated by a drive shaft, and the face of the rider upon which the tappet is supported may be substantially flat or planar. In this way, the tappet effectively isolates the plunger from the lateral or transverse movement of the rider via the rotatable bearing element(s).

In one embodiment, each bearing element is accommodated in a cavity such that the bearing element is recessed into the body of the tappet. The cavity may have a cross-section which substantially conforms to an outer profile of the respective bearing element. In this way, the rotatable bearing element is able to provide an at least partial hydrodynamic bearing for the tappet. The cross-section of each cavity in the tappet body for receiving a respective rotatable bearing element may encompass and/or substantially conform to at least 50 percent, and typically more than 50 percent (e.g. 60 to 80 percent), of an outer profile or circumference of the bearing element.

In one embodiment, the tappet has a block-like body (e.g. a substantially rectangular block-like body) and accommodates a plurality of rotatable bearing elements in respective cavities such that each bearing element is partly recessed into the tappet body. Each rotatable bearing element may be elongate and generally cylindrical, e.g. in the form of a needle roller, and the rotatable bearing elements may be arranged to extend substantially parallel to one another. The cavities in the body of the tappet therefore typically comprise substantially parallel channels for receiving and retaining the rotatable bearing elements, with each of the channels having a cross-section substantially conforming to an outer profile, or partial outer profile, of the respective bearing element. When the cross-section of each cavity encompasses over 50 percent of an outer profile or circumference of a respective cylindrical bearing element, the cavities—or rather, the tappet body—can effectively hold or retain those bearing elements in the radial direction while also providing a hydrodynamic bearing for the tappet.

In one embodiment, the cylinder of the pump is formed in a cylinder block or body and surrounds or encloses a chamber or bore. Typically, the plunger is at least partially housed in the chamber or bore of the cylinder and is reciprocally movable to pressurize the pump chamber formed in the bore of the cylinder. In this regard, a free end of the plunger may act like a piston, in the sense that an end face of the plunger exerts pressure on the liquid (e.g. fuel) contained in the cylinder during the stroke or movement of the plunger into the bore of the cylinder. The pump may comprise a plurality of cylinders, each of which has a respective plunger that is reciprocally driven by the eccentric on the drive shaft to pressurize the pump chamber in that cylinder. The rider, which is rotatably mounted on the eccentric, may thus present a separate face to each respective plunger, and a separate tappet is associated with each respective plunger for transmitting reciprocal movement from the rider to that plunger. In one embodiment, the plurality of cylinders are arranged spaced apart around the eccentric and extending radially such that the pump takes the form of a radial piston pump.

In one embodiment, the pump further includes guide means for constraining the tappet body against rotation about a central or longitudinal axis of the plunger. In this way, an unwanted or inadvertent rotation of the tappet body which could move the bearing elements out of their proper alignment for rolling movement on the face of the rider can be prevented. The guide means may include one or more guide members attached to the tappet body, wherein each of the one or more guide members cooperates with a respective slot or bore in the cylinder block or pump housing to guide and maintain a desired orientation of the tappet throughout a stroke of the plunger. Alternatively, or in addition, the guide means may include a recess and sides of the recess for accommodating the tappet body in the pump housing.

In one embodiment, the pump further comprises a retaining device for retaining the at least one rotatable bearing element in the tappet body during relative movement of the tappet over the face of the rider. The retaining device may be provided in the form of a clip and may comprise at least one elongate retaining member which extends across an axial end of the rotatable bearing element recessed in the tappet body. In this way, the retaining device can prevent unwanted movement or loosening of the bearing elements in the axial direction.

In one embodiment, a pump for delivering fuel in a common rail fuel injection system can be realized, with which hitherto unattainable fuel pressures of up to 4000 bar can be achieved, while nevertheless avoiding problems of excessive heat generation. Furthermore, such pressures can be achieved without enlarging the size of the pump components to such an extent that space availability in the engine or the fatigue strength of the components becomes a significant issue.

Other embodiments provide a common rail fuel injection system for an internal combustion engine comprising a common rail for distributing fuel to a plurality of fuel injectors associated with combustion cylinders of the engine and a pump as disclosed herein as described above for delivering fuel at high pressure to the common rail.

Referring firstly to FIG. 1 of the drawings, an example embodiment of a pump 1 is shown schematically in the form of a radial piston pump for delivering fuel at high pressure to a common rail in a common rail fuel injection system. The pump 1 comprises a cylinder 2, which surrounds or encompasses a chamber or bore 3 and is formed in a hydraulic head or cylinder block 4. A cylindrical plunger 5 is at least partially housed in the chamber or bore 3 and is reciprocally movable to pressurize the pump chamber 3 in the cylinder 2. Typically, the bore 3 of the cylinder 2 will have a diameter that is only slightly larger (e.g. in the range of 10 to 500 μm) than an outer diameter of the plunger 5. As such, a non-sealing fit between the chamber or bore 3 of the cylinder 2 and sides of the plunger 5 is provided, i.e. with a small amount of "play". On the upward stroke of the plunger 5 (i.e. upwards in FIG. 1), the upper or free end of the plunger 5 acts to pressurize fuel (e.g. diesel fuel) at an upper end of the bore 3 which forms the pump chamber.

The plunger 5 is driven for reciprocating or reciprocal movement in the chamber or bore 3 of the cylinder 2 by an eccentric 6 provided on a drive shaft 7, which rotates about its axis A. In this connection, the pump 1 includes a rider 8 which is rotatably mounted on the eccentric 6 so as to allow rotation of the eccentric 6 relative to the rider 8. As is clear from FIG. 1, the rider 8 is formed with two opposite flat faces 9, one of which faces towards the plunger 5. A tappet 10 having a rectangular block-like body 11 is supported on that face 9 of the rider 8 and is designed to transmit reciprocating movement from the eccentric 6 to the plunger 5 via the rider, thereby to drive the plunger 5 in reciprocal motion in the chamber or bore 3 of the cylinder 2 and thereby pressurize the pump chamber in the cylinder.

Guide members 12 in the form of four pins are provided at each of four corners of the rectangular block-like body 11 of the tappet 10 to guide reciprocal movement of the plunger 5 in the bore 3. In this connection, a slot or recess 13 is formed in the cylinder block 4 around the cylinder 2 and the guide pins 12 move freely in reciprocating motion in the slot or recess 13 with a small amount of "play" in the lateral direction. Not only does this help ensure correct orientation of the plunger 5 in the cylinder 2, but the guide pins 12 particularly serve to prevent the tappet 10 from undergoing any rotation about a central or longitudinal axis of the cylinder 2 or bore 3 during operation of the pump 1.

Furthermore, a return spring S is arranged in the slot or recess 13 to bias the plunger 5 downwardly in FIG. 1 during a non-pressurizing or return stroke of the plunger 5. More specifically, on the downward or return stroke of the reciprocating plunger 5, the pump chamber 3 in the cylinder 2 is typically filled with fuel; i.e. fuel is drawn into the chamber at the upper region of the bore 3. On the upward stroke of the plunger 5, the fuel in the chamber of the cylinder 2 is then pressurized by the upper or free end of the plunger 5 for delivery to the common rail of the fuel injection system under high pressure.

Figure 2:
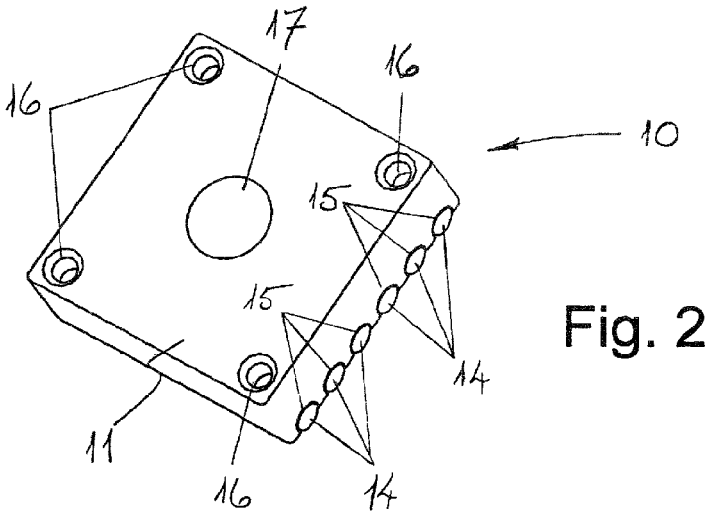
FIG. 2 depicts a perspective view of the tappet and bearing elements of the pump of FIG. 1.

With reference now to both FIG. 1 and FIG. 2, the tappet 10 is supported by a plurality of rotatable bearing elements 14 for rolling movement transversely over the flat face 9 of the rider 8 during operation of the pump 1. Each of the bearing elements 14 is elongate and generally cylindrical, i.e. in the form of a needle roller, and the bearing elements 14 are accommodated partially recessed in the block-like body 11 of the tappet 10 arranged side-by-side and substantially parallel to one another. Thus, each of the needle rollers 14 is accommodated in a respective cavity or channel 15 having a partially cylindrical cross-section substantially conforming to an outer profile of the respective bearing element 14. It will of course be appreciated that each cavity or channel 15 is dimensioned to allow the respective bearing element or needle roller 14 to rotate freely therein.

As the cross-section of each cavity or channel 15 encompasses over fifty percent (50%) of an outer profile or circumference of the respective cylindrical needle roller 14, each needle roller 14 is substantially recessed into the tappet body 11 and the cavities—or rather, the tappet body—effectively holds or retains the bearing elements in the reciprocating or radial direction. Referring to FIG. 2, the individual needle rollers 14 can thus be inserted in the axial or longitudinal direction into their respective channels 15. Further, the conforming surfaces of the cylindrical needle rollers 14 and their respective cavities or channels 15 can combine with a lubricating fluid, such as oil, to provide a (partial) hydrodynamic bearing for the tappet 10 on the face 9.

As can be seen in FIG. 2, holes 16 are provided in the four corners of the upper side of the block-like tappet body 11 for fixing the guide pins 12 shown in FIG. 1. Furthermore, a central aperture 17 is provided in the tappet body 11 for attachment of the plunger 5 to the tappet 10. Preventing the possibility of the tappet body 11 rotating about the vertical axis in FIG. 1 via the guide pins 12 is especially desirable because rotation of the tappet body 11 would cause the needle rollers 14 to run at an angle to the direction of the lateral movement of the rider 8, causing them to skid over the face 9 of the rider. In turn, that skidding would cause substantial wear and dramatically reduce the life of the pump 1. Above, the guide pins 12 are described as moving reciprocally in a slot 13. More practically, however, each guide pin 12 may have its own matching bore 13 machined into the hydraulic head or cylinder block 4 for a precise sliding fit, to thus constrain the tappet 10 against unwanted rotation about the axis of the plunger 5 and thereby maintain an optimal rolling orientation of the bearing elements. In this connection, a single guide pin 12 may suffice, although two or four guide pins 12 may be provided.

Referring again to FIG. 1, it will be noted that the pump 1 includes a housing H which accommodates the tappet body 11 in a recess 18 enclosed by sides 19 of the housing H. Where one or more guide pins 12 is/are used to prevent rotation of the tappet 10, the recess 18 can be dimensioned considerably larger than the block-like tappet body 11. Accordingly, the tappet body 11 is not in contact with the sides 19, such that wear and heat generation are avoided, together with the need for special machining or treatment of the block-like body 11 and/or the sides 19 of the recess 18, thereby reducing costs, especially when the housing is made of aluminium.

As an alternative to employing the guide pins 12 to constrain the tappet 10 against unwanted rotation, however, it will be noted that one could configure the recess 18 and sides 19 of the housing H to essentially conform to the geometry of the block-like tappet body 11. In this way, the sides 19 could be configured to form a recess 18 that would match and neatly accommodate the rectangular or square shape of the tappet 10. With close tolerances, the tappet body 11 would be free to move in reciprocating, vertical sliding movement but would be prevented from inadvertently rotating about the longitudinal axis of the plunger 5 and thus maintain the optimal rolling orientation of the bearing elements 14. Because the tappet 10 in this case would be in close contact with the sides 19 of the recess 18, it would require special treatment to avoid excessive wear.

Figure 3:
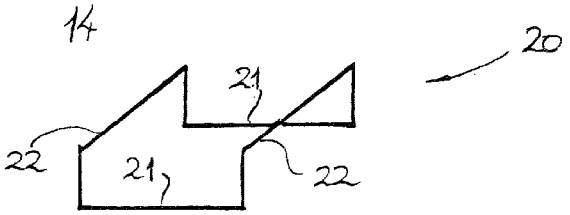
FIG. 3 depicts a schematic perspective view of a retaining device of the pump of FIG. 1.

Referring now to FIG. 3, it will be noted that the pump 1 also includes a retaining device 20 in the form of a clip—visible in FIG. 1—for retaining the needle rollers 14 in the tappet body 11 during operation of the pump 1, and in particular during relative movement of the tappet 10 over the face 9 of the rider 8. In this exemplary embodiment, the retaining clip 20 comprises a resilient framework of elongate members, two of which are retaining members 21 that extend across the axial ends of the needle rollers 14 and their respective channels 15 in the block-like tappet body 11. In this way, the retaining members 21 of the clip 20 prevent unwanted movement or loosening of the needle rollers 14 in the axial direction. Ends of the two elongate retaining members 21 are interconnected by frame or carrying members 22, which together form a saddle- or hanger-like structure for attaching the clip 20 to the tappet 10 and for suspending the retaining members 21 in the right position to cover or impinge on the channels 15 across the axial ends of the needle rollers 14.

With reference again to FIG. 1, it will be noted that the cylinder 2 and the cylinder block 4 are shown in cross-section for ease of illustration.

Further, it will be noted that the pump 1 of the embodiment in FIG. 1 also includes a second cylinder with a second bore in the cylinder block 4 and a second plunger with an associated tappet at the second face 9 on the lower side of the rider 8, but that these features of the pump 1 have been omitted from FIG. 1 to simplify the illustration. It will also be appreciated that the rider 8 of the pump 1 may alternatively include a greater number of faces 9 spaced apart around its periphery and a corresponding greater number of cylinders and plungers. Each cylinder 2 of the pump 1 is connected—typically via a valve—for fluid communication with the common rail of the fuel injection system.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting scope.

LIST OF REFERENCE SIGNS

1 pump
2 cylinder
3 chamber or bore
4 cylinder block
5 plunger
6 eccentric
7 drive shaft
8 rider
9 face
10 tappet
11 tappet body
12 guide member
13 annular slot or recess
14 bearing element or needle roller
15 cavity or channel
16 hole
17 central aperture
18 recess
19 side of recess
20 retaining clip
21 retaining member
22 frame member
A drive shaft axis
S spring
H pump housing

What is claimed is:

1. A pump for delivering liquid at high pressure, especially for delivering fuel at high pressure to a common rail of a common rail fuel injection system for an internal combustion engine, the pump comprising:

a cylinder that includes a pump chamber, wherein the cylinder is formed within a cylinder block;

a plunger reciprocally driven by an eccentric to pressurize the pump chamber;

a rider mounted on the eccentric, wherein the rider presents one or more faces to the plunger;

a square tappet supported within a housing opening, wherein the tappet transmits reciprocal movement from the rider to the plunger and including four guide pins disposed at each corner of the square tappet configured to prevent rotation of the tappet about a longitudinal axis of the cylinder, and a plurality of rotatable bearing elements that allow transverse movement of the tappet on the one or more faces of the rider, each of the plurality of rotatable bearing elements including a longitudinal axis and two axial ends, and a clip removably fastened to the tappet, the clip comprising two retaining members extending across the axial ends of the plurality of rotatable bearing elements and an integral frame extending between the two retaining members, wherein the rotatable bearing elements are at least partially recessed in a body of the tappet, and wherein the two retaining members of the clip restrain the rotatable bearing elements against axial movement in relation to the body of the tappet.

2. The pump of claim 1, wherein the tappet has a block-like body and accommodates the plurality of rotatable bearing elements in respective cavities such that each bearing element is recessed in the tappet body.

3. The pump of claim 2, wherein each rotatable bearing element is elongated and generally cylindrical, and wherein the plurality of rotatable bearing elements are arranged to extend substantially parallel to one another.

4. The pump of claim 3, wherein the cavities in the body of the tappet comprise substantially parallel channels for receiving and retaining the rotatable bearing elements, wherein each of the channels has a cross-section substantially conforming to an outer profile of the respective bearing element.

5. The pump of claim 4, wherein the cross-section of each cavity formed in the tappet body encompasses at least 50 percent of the outer profile of the respective bearing element.

6. The pump of claim 1, wherein the face of the rider upon which the tappet is supported is substantially flat or planar.

7. The pump of claim 1, wherein rotation of the tappet about a longitudinal axis of the cylinder is prevented by configuring the shape of the housing opening to match the shape of the tappet body.

8. The pump of claim 1, wherein rotation of the tappet about a longitudinal axis of the cylinder is prevented by configuring the cylinder block to include one or more recesses that receive the four guide pins located on the tappet.

9. The pump of claim 1, wherein:

the pump comprises a plurality of cylinders, each having a plunger reciprocally driven by the eccentric to pressurize the pump chamber in the cylinder, and the rider rotatably mounted on the eccentric presents a separate face to each respective plunger, and a separate tappet is associated with each respective plunger for transmitting reciprocal movement from the rider to the respective plunger.

10. A common rail fuel injection system for an internal combustion engine comprising:

a common rail for distributing fuel to a plurality of fuel injectors associated with combustion cylinders of the engine, and a pump for delivering fuel at high pressure to the common rail, the pump comprising:

a cylinder that includes a pump chamber, wherein the cylinder is formed within a cylinder block, a plunger reciprocally driven by an eccentric to pressurize the pump chamber, a rider mounted on the eccentric, wherein the rider presents one or more faces to the plunger, a square tappet supported within a housing opening, wherein the tappet transmits reciprocal movement from the rider to the plunger and including four guide pins disposed at each corner of the square tappet configured to prevent rotation of the tappet about a longitudinal axis of the cylinder, and a plurality of rotatable bearing elements that allow transverse movement of the tappet on the one or more faces of the rider, each of the plurality of rotatable bearing elements including a longitudinal axis and two axial ends, and a clip removably fastened to the tappet, the clip comprising two retaining members extending across the axial ends of the plurality of rotatable bearing elements and an integral frame extending between the two retaining members, wherein the rotatable bearing elements are at least partially recessed in a body of the tappet, and wherein the two retaining members of the clip restrain the rotatable bearing elements against axial movement in relation to the body of the tappet.

11. The system of claim 10, wherein the tappet has a block-like body and accommodates the plurality of rotatable bearing elements in respective cavities such that each bearing element is recessed in the tappet body.

12. The system of claim 11, wherein each rotatable bearing element is elongated and generally cylindrical, and wherein the plurality of rotatable bearing elements are arranged to extend substantially parallel to one another.

13. The system of claim 12, wherein the cavities in the body of the tappet comprise substantially parallel channels for receiving and retaining the rotatable bearing elements, wherein each of the channels has a cross-section substantially conforming to an outer profile of the respective bearing element.

14. The system of claim 13, wherein the cross-section of each cavity formed in the tappet body encompasses at least 50 percent of the outer profile of the respective bearing element.

15. The system of claim 10, wherein rotation of the tappet about a longitudinal axis of the cylinder is prevented by configuring the shape of the housing opening to match the shape of the tappet body.

16. The system of claim 10, wherein rotation of the tappet about a longitudinal axis of the cylinder is prevented by configuring the cylinder block to include one or more recesses that receive the four guide pins located on the tappet.

17. The system of claim 10, wherein:

the pump comprises a plurality of cylinders, each having a plunger reciprocally driven by the eccentric to pressurize the pump chamber in the cylinder, and the rider rotatably mounted on the eccentric presents a separate face to each respective plunger, and a separate tappet is associated with each respective plunger for transmitting reciprocal movement from the rider to the respective plunger.

* * * * *